United States Patent [19]

Mestas et al.

[11] Patent Number: 4,960,064

[45] Date of Patent: Oct. 2, 1990

[54] LAND ANCHOR FOR A BOAT

[76] Inventors: Gilbert L. Mestas; Joseph G. Mestas, Jr., both of 606 E. 5th St., Pueblo, Colo. 81001

[21] Appl. No.: 422,419

[22] Filed: Oct. 17, 1989

[51] Int. Cl.[5] ..... E21B 11/02

[52] U.S. Cl. ..... 114/230; 114/293; 55/161; 173/132

[58] Field of Search ..... 114/293–295, 114/297, 298, 230; 52/155, 156, 158, 160–166, 150, 151, 105, D16, 11; 175/320, 325; 135/118; 119/121; 248/500, 507, 508; 405/195, 224, 227, 228; 133/90, 91, 128, 132

[56] References Cited

U.S. PATENT DOCUMENTS

| | | | |
|---|---|---|---|
| 1,044,870 | 11/1912 | Enochs | 52/162 |
| 3,036,482 | 5/1962 | Kenworthy | 173/90 |
| 3,696,873 | 10/1972 | Anderson | 173/132 |
| 3,774,361 | 11/1973 | Tanner | 52/162 |
| 4,101,088 | 7/1978 | Stanth | 173/91 |
| 4,241,795 | 12/1980 | Vandry | 173/132 |
| 4,421,180 | 12/1983 | Fleishman | 173/132 |
| 4,589,500 | 5/1986 | Moraly | 123/132 |
| 4,702,047 | 10/1987 | Stokes | 52/156 |
| 4,756,128 | 7/1988 | Daniel | 52/156 |

*Primary Examiner*—Joseph F. Peters, Jr.
*Assistant Examiner*—Clifford T. Bartz
*Attorney, Agent, or Firm*—T. M. Gernstein

[57] ABSTRACT

A land anchor includes a hammer element that permits the anchor to be driven into the soil. The anchor also includes a stabilizing assembly that increases the anchoring force of the anchor for loose soils. The stabilizing assembly includes a wing section that is expanded from a stored, ground-entering configuration to a ground-gripping configuration by operation of a screw extending within a central rod of the anchor. The hammer is located on the rod.

3 Claims, 3 Drawing Sheets

LAND ANCHOR FOR A BOAT

TECHNICAL FIELD OF THE INVENTION

The present invention relates to the general art of supports, and to the particular field of boat anchors.

BACKGROUND OF THE INVENTION

The sport of boating has enjoyed tremendous popularity and a substantial increase in popularity in recent years.

As more and more people participate in boating and boating-related activities, there is a concomitant increase in demand for boating accessories. For example, many people use their boat to reach out-of-the way places to fish, picnic, swim or the like. In such out-of-the way places, boat docking facilities may be non-existent or minimal at best. Under such conditions, a boater may be forced to tie his boat to a tree or the like since a traditional anchor may not be suitable. Such a boat docking method is not satisfactory, especially if there is a possibility of choppy water and/or high winds. Furthermore, suitable trees or limbs may not be accessible from the boat location that is most suitable to the boat owner.

Therefore, the anchoring field of the art has included several designs for shoreline or beach anchors. See, for example, the anchors disclosed in U.S. Pat. No. 3,774,361 and U.S. Pat. No. 4,756,128.

However, these devices can be cumbersome to store and to use, and may still not be totally effective under all circumstances and conditions. Still further, such devices are nota capable of having the anchoring features thereof adjusted to fit the particular ground conditions encountered. Thus, for example, should the ground be quite loose, these anchors cannot be adjusted to increase the ground-gripping function for such loose soil over that ground-gripping feature used in dense soil. This drawback may make the anchor overly difficult to insert into dense soil, and yet make that same anchor too loosely embedded in loose soil.

Therefore, there is a need for a land anchor for a boat which is easy to use, set up, and store, and yet is adaptable for various soil conditions.

OBJECTS OF THE INVENTION

It is a main object of the present invention to provide a boat which is easy to use, set up, and store.

It is another object of the present invention to provide a boat which is easy to use, set up, and store, and yet is adaptable for various soil conditions.

SUMMARY OF THE INVENTION

These, and other, objects are achieved by a land anchor for a boat which has a self-driving feature and an anchor stabilizing assembly which can be actuated to different degrees according to the amount of additional anchoring required according to various soil conditions existing at the anchoring site.

The stabilizing assembly includes a collapsible section and a bolt-operated screw connected to that section. Operation of the bolt expands or abbreviates a wing with respect to a central rod. The rod has a driver thereon, and the wing can be expanded to its fullest extent outwardly of the rod if the soil conditions so warrant, or it can be abbreviated or never expanded at all if the soil is dense. Dense soil may make it unnecessary and difficult to expand the wing. Expansion of the wing increases the surface area of the anchor perpendicular to the direction with which the anchor is being pulled by a boat tethered thereto. The amount of expansion can be adjusted according to the soil conditions.

In this manner, the amount of anchoring force associated with the device can be increased to account for loose soils. Likewise, the anchoring force which is solely associated with the anchor rod itself can be used. Such exclusive use of the rod may be suitable for extremely dense soil; whereas, looser soil may require some extension of the wing in order to establish a proper amount of anchoring force.

BRIEF DESCRIPTION OF THE DRAWING FIGURES

DETAILED DESCRIPTION OF THE PREFERRED EMBODIMENT OF THE INVENTION

Figure 1:
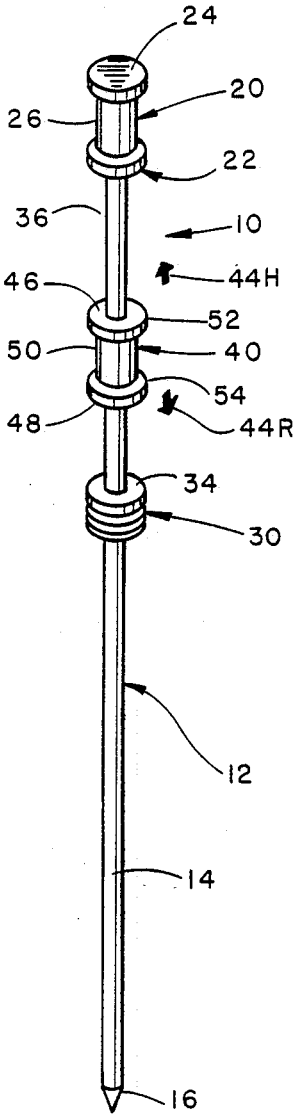
FIG. 1 is a perspective view of a land anchor embodying the present invention.

Shown in FIG. 1 land anchor 10 embodying the present invention. The land anchor 10 includes an elongated hollow rod 12 that forms the central body of the anchor. The rod 12 can be made of any suitable material, such as stainless steel or the like, and is cylindrical in shape to have a wall 14 that has a ground-engaging point 16 on one end thereof and a top on the other end thereof. An external thread 18 (best seen in FIG. 3) is located adjacent to the top end for a purpose to be discussed below.

Figure 3:
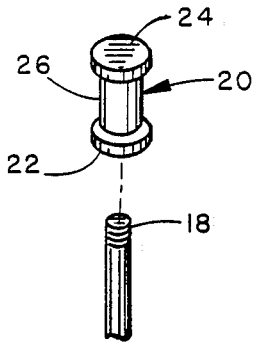
FIG. 3 is a perspective view of a handle in conjunction with a threaded portion of the anchor.
Figure 2:
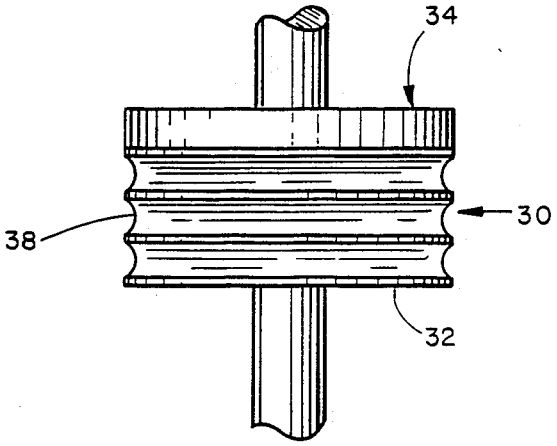
FIG. 2 is a perspective view of a rope engaging element of the land anchor.

The rod is forced into the soil adjacent to a body of water and extends above the top surface of that soil to provide a tethering fixture for a boat line. The anchor further includes a handle 20 that is best shown in FIGS. 1 and 3 as being fixedly mounted on the top end of the rod. The handle is cylindrical and includes an internally threaded bore that threadably co-operates with the external threads of the rod to couple that handle to the rod as shown in FIG. 1. The handle includes an annular abutting surface 22 encircling the rod and facing toward the point 16, and a top end 24 on top of the handle. The handle has a cylindrical grasping surface 26 connecting the surfaces 22 and 24. The anchor is held in a chosen position and orientation by grasping the surface 26 with one hand.

The anchor further includes a rope engaging element 30 that is fixedly mounted on the rod between the point and the top end. The rope engaging element is cylindrical in shape and includes an annular bottom surface 32 facing towards the point, and an annular abutting surface 34 encircling the rod and facing the handle abutting surface 22 to be in confronting relationship therewith.

The element 30 has a bore defined centrally therethrough so the rod can be received longitudinally of that element. The abutting surfaces 22 and 34 are spaced apart along the longitudinal centerline of the rod to define a hammering gap 36 therebetween. A plurality of circular grooves, such as groove 38, encircle the outside surface of the element 30. A rope from a boat is wrapped around the element 30 and is engaged in the grooves to tie the boat to the anchor.

A cylindrical hammer element 40 is slidably mounted on the rod in the gap 26 to slidably move from a handle abutting surface contacting position to a rope engaging element abutting surface contacting position as indicated by arrows 44H and 44R in FIG. 1.

The hammer element includes an annular handle impacting surface 46 and an annular rope engaging element impacting surface 48 that are connected together by a cylindrical outer wall 50. The annular impacting surfaces of the hammer encircle the rod and include reinforcing flanges 52 and 54 on the hammer element. The hammer element includes a centrally located bore extending longitudinally thereof and through which the rod extends.

The anchor 10 is driven into the soil by placing the point 16 against the upper surface of the soil, orienting the anchor at the desired angle with respect to that upper surface, and repeatedly driving the hammer element 40 downwardly against the abutting surface 34 and moving that hammer element back to a position spaced from the surface 34 between blows until the anchor is driven into the soil the desired distance. The abutting and impacting surfaces are made of a hardened material so that the just-discussed hammering process can be carried out. The hammer element and the other elements of the anchor can also be covered with rubber-type material to improve the grip and comfort of the anchor. Other coatings can be used as necessary and desirable.

Figure 4:
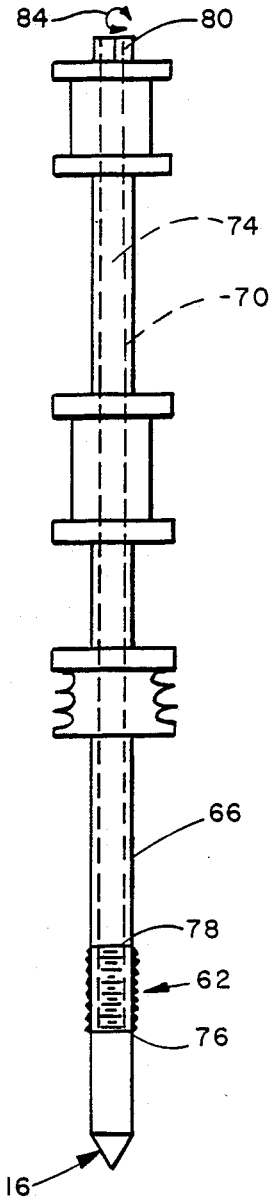
FIG. 4 is a side elevational view of a land anchor of the present invention with a stabilizing assembly in a collapsed configuration.
Figure 5:
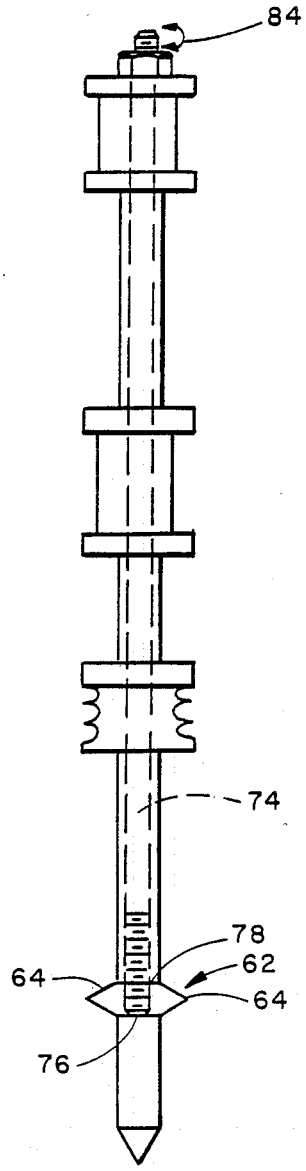
FIG. 5 is a side elevational view of a land anchor of the present invention with a stabilizing assembly in a fully deployed configuration.

In order to compensate for loose soil, one form of the anchor of the present invention includes a stabilizing assembly 60, best shown in FIGS. 4 and 5. The stabilizing assembly 60 includes a wing section 62 that moves from a stored configuration shown in FIG. 4 having the wing 64 thereof in flush relationship with outer surface 66 of the rod adjacent to the point 16, to a deployed configuration shown in FIG. 5 having the wing 64 spaced radially outward of that outer surface 66. The wing 64 is accordion like to be flexible outwardly of the surface 66 from the FIG. 4 condition to the FIG. 5 condition or to some condition therebetween.

In the deployed configuration, the wing presents a surface 64U that is oriented to be essentially perpendicular to the direction the anchor rod will have to move to be withdrawn from the soil. This wing thus presents a surface that resists such withdrawal of the anchor and serves to increase the anchoring force of the anchor 10. However, the wing in the stored FIG. 4 condition will not impede the insertion of the anchor into the soil.

The wing is moved from the stored configuration to the deployed configuration, or to a configuration intermediate these two end conditions according to the conditions of the soil, by a moving means, generally indicated in FIGS. 4 and 5 at 70. The rod 12 is hollow to have a bore 72 defined longitudinally thereof, and a screw 74 is positioned in that bore to extend along the longitudinal centerline of the rod from the handle top 24 to a location adjacent to the bottom of the stored wing. A first plate 76 is fixedly mounted to the rod at the bottom of the wing section, and is attached to the screw 74 at the lowermost end of that screw. The screw is attached to the plate 76 by a bearing so that the screw is fixed to the plate with respect to plate movement in the longitudinal direction of the rod yet the screw can rotate with respect to the plate about the longitudinal axis of the screw.

A second plate 78 is fixedly mounted to the inner surface of the rod at the top of the wing section so that the wing section is located between the plates 76 and 78. The plate 78 has a threaded bore defined centrally therethrough through which the screw 74 is received. The screw 74 has an external thread 80 located thereon to be adjacent to the plate 78, and the plate 78 has an internal thread defined thereon adjacent to the bore through which the screw extends. The thread on the plate 78 is defined so that rotation of the screw in one direction forces the plate 78 towards the plate 76, while rotation of the screw in the opposite direction forces the plate 78 away from the plate 76. A bolt 80 is rotatably fixed to the top of the handle and is connected to the screw to rotate that screw as just described. Rotation of the screw via the bolt is indicated in FIGS. 4 and 5 by the double-headed arrow 84, and can be achieved by hand or by means of a wrench or like device.

Since the plates 76 and 78 are fixed to the rod, and since the wing section is formed of an accordion-like section, movement of the plate 76 toward plate 78 due to the rotation of the screw 74 will force the wing section outwardly from the FIG. 4 condition to the FIG. 5 condition.

The wing is moved back from the FIG. 5 deployed configuration to the FIG. 4 stored configuration before the anchor is withdrawn from the soil. Withdrawal of the anchor is effected by repeatedly impacting the hammer 40 against the handle abutting surface 22 while withdrawing the hammer away from that surface between blows.

Figure 6:
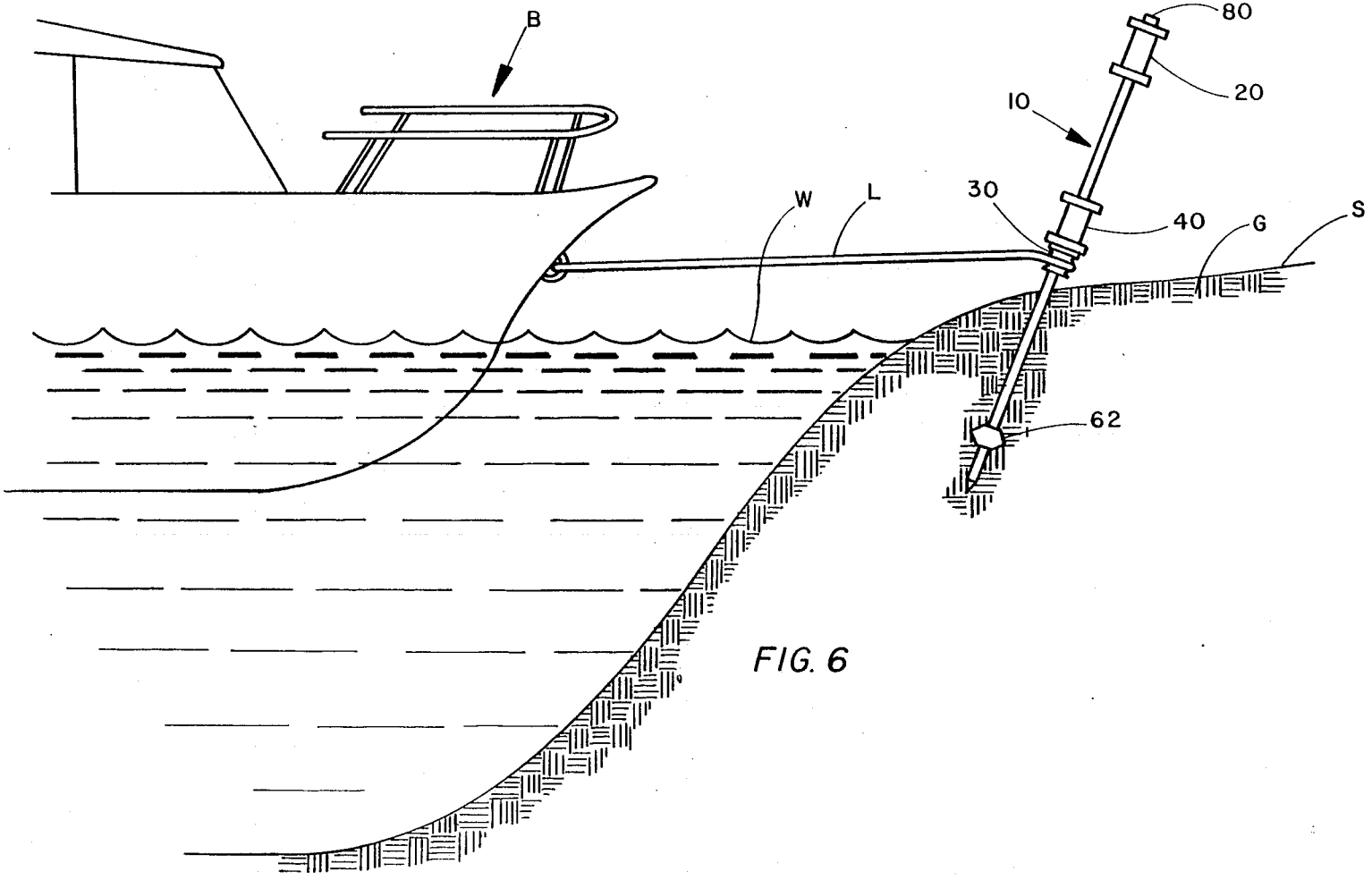
FIG. 6 is a perspective view of a boat tethered to a land anchor having a stabilizing assembly deployed and mounted in the ground adjacent to the body of water containing the boat.

The anchor is shown in FIG. 6 in the anchoring position in soil G adjacent to a body of water W having a boat B therein. The wing is fully deployed in FIG. 6, and the boat is tethered to the anchor by a line L tied to the rope engaging element 30. The anchor is set into the ground at angle that is most suitable to anchoring the boat in the most stable manner, and thus need not be perpendicular to the surface S of the ground. The wing will be oriented to present the largest area in the position that is most effective in anchoring the boat.

It is understood that while certain forms of the present invention have been illustrated and described herein, it is not to be limited to the specific forms or arrangements of parts described and shown.

We claim:

1. A land anchor for a boat comprising:

A) an elongated hollow rod having a point on one end and an external threaded portion adjacent to a second end, and a cylindrical wall having an outer surface connecting said point to said second end;

B) a handle threadably fixed to said rod on said rod second end, said handle having an annular abutting surface located in surrounding relationship with said rod threaded portion and a top end;

C) a rope engaging element fixedly mounted on said rod at a location spaced from said handle, said rope engaging element being cylindrical and including (1) a plurality of rope receiving circular grooves defined in the outer surface of said rope engaging element, (2) an annular abutting surface which is located in surrounding relationship with said rod and which is spaced from said handle abutting surface along the longitudinal direction of said rod to define a hammering gap, said handle abutting surface and said rope engaging element abutting surface being in confronting relationship with each other;

D) a cylindrical hammer element slidably mounted on said rod between said handle and said rope engaging element abutting surfaces to move in said hammering gap and including (1) an annular handle impacting surface which is in surrounding relationship with said rod and in confronting relationship with said handle abutting surface to contact said handle abutting surface when said hammer element is slidably moved into a first position, (2) an annular rope engaging element abutting surface which is in surrounding relationship with said rod and in confronting relationship with said rope engaging element abutting surface to contact said rope engaging element abutting surface when said hammer element is slidably moved to a second position, and (3) a gripping surface between said handle impacting surface and said rope engaging element impacting surface; and E) an anchor stabilizing assembly which includes (1) a wing section in said rod near said rod point, said wing section being flush with said rod wall outer surface in a ground inserting position of said stabilizing assembly and extending outwardly from said wall outer surface in a ground gripping position of said stabilizing assembly, and (2) moving means on said rod and connected to said wing section for moving said wing section between said ground inserting position and said ground gripping position.

2. The anchor defined in claim 1 wherein said moving means includes (1) a first plate fixedly mounted on an inner surface of said hollow rod at one end of said wing section adjacent to said rod point, (2) a second plate fixedly mounted on the inner surface of said hollow rod at a second end of said wing section, said second plate being annular and having a bore defined centrally therethrough, and (3) plate moving means connecting said first plate to said second plate and moving said first and second plates toward each other to force said wing section from said ground inserting position into said ground gripping position.

3. The anchor defined in claim 2 wherein said plate moving means includes (a) a screw located within said hollow rod to extend longitudinally of said rod, said screw being fixed to said first plate and extending through said second plate, (b) screw threads on said second plate adjacent to said second plate bore and being sized and arranged to cooperate with the threads in said screw to move said second plate as said screw is rotated about the longitudinal axis thereof to force said second plate towards said first plate when said screw is rotated one direction and to force said second plate away from said first plate when said screw is rotated in a direction opposite to said one direction, and (c) a bolt rotatably mounted on said handle top and fixed to said screw to rotate said screw when said bolt is rotated.

* * * * *